United States Patent [19]

Carter

[11] Patent Number: 4,944,241

[45] Date of Patent: Jul. 31, 1990

[54] ENGINE VACUUM-CONDITION RESPONSIVE SAFETY SYSTEM

[76] Inventor: John A. Carter, 40 Williams La., Foster City, Calif. 94404

[21] Appl. No.: 385,772

[22] Filed: Jul. 26, 1989

[51] Int. Cl.[5] ..... B63J 2/06

[52] U.S. Cl. ..... 114/211; 123/198 D; 440/1

[58] Field of Search ..... 114/211; 440/1; 98/1; 123/198 D; 307/9.1; 340/517, 521, 522, 527, 626, 632, 633, 634

[56] References Cited

U.S. PATENT DOCUMENTS

| | | | |
|---|---|---|---|
| 3,292,568 | 12/1966 | Morrell | 440/1 |
| 3,462,964 | 8/1969 | Haroldson | 62/133 |
| 3,489,912 | 1/1970 | Hoffman, Jr. | 307/9 |
| 3,652,868 | 3/1972 | Hunt | 307/116 |
| 3,675,034 | 7/1972 | Abplanalp | 307/9 |
| 3,918,543 | 11/1975 | Halem | 180/77 |
| 3,948,202 | 4/1976 | Yoshikawa | 114/211 |
| 3,951,091 | 4/1976 | Döench | 114/211 |
| 4,226,090 | 10/1980 | Horian | 62/133 |
| 4,235,181 | 11/1980 | Stickney | 114/211 |
| 4,473,025 | 9/1984 | Elliott | 114/211 |

*Primary Examiner*—Sherman D. Basinger
*Attorney, Agent, or Firm*—Thomas Schneck

[57] ABSTRACT

A safety system associated with an engine of a marine vessel wherein the safety system includes a blower, a control unit, and a plurality of sensors. A vacuum sensor is coupled to the intake manifold of the engine of the vessel for the detection of pressure at the intake manifold. The vacuum sensor transmits a signal to the control unit, with the signal having a characteristic corresponding to the pressure at the intake manifold. Detection of a vacuum condition associated with engine idling or low cruise operation causes the control unit to activate the blower. The safety system includes interactive heat sensors and vapor sensors to monitor the atmosphere in an engine compartment. Detection of a volatile environment activates the blower and triggers both an audio and a visual warning.

18 Claims, 3 Drawing Sheets

ENGINE VACUUM-CONDITION RESPONSIVE SAFETY SYSTEM

TECHNICAL FIELD

The present invention relates generally to safety apparatus for boats and more particularly to control of a ventilation device for a marine engine compartment.

BACKGROUND ART

While boating is generally a safe sport, the fuels which power marine engines emit vapors that are potentially dangerous. Pleasure vessels typically have an internal combustion engine that is enclosed within an engine compartment to shield users from fumes and noise. However, inadequate ventilation of the engine compartment can result in an accumulation of combustible vapor. The mixture of vapor and air provides an explosive condition which can be ignited by the spark from an alternator or simply by a hot exhaust manifold or any unshielded electrical component. Every year, thousands of pleasure vessels undergo a fire or an explosion. Preventative devices are increasingly common, but the number of fires and explosions continue to increase each year.

A first hazardous time in which accumulated vapor is likely to explode is upon ignition of the engine. An inactive marine engine emits vapor which is more dense than air. The vapor accumulates at the bottom of an engine compartment. The U.S. Coast Guard requires installation of a ventilation system for inboard engine vessels, and recommends that the ventilation system be energized for a sufficient period of time prior to engine ignition so as to purge the engine compartment of combustible vapor. U.S. Pat. Nos. 4,473,025 to Elliott, 4,235,181 to Stickney, 3,951,091 to Doench, 3,948,202 to Yoshikawa, 3,675,034 to Abplanalp et al., 3,652,868 to Hunt and 3,489,912 to Hoffman, Jr. all teach blocking circuits for inboard engine ignitions which allow a blower to exhaust explosive fumes from an engine compartment prior to engine ignition.

A second potentially hazardous time is that time in which a marine vessel is idling, is decelerating, or is engaged at a low-cruise level. During such time, the engine operates on a richer fuel/air ratio and supplies a higher concentration of vapor. Moreover, because the marine vessel is either stopped or moving relatively slowly, there is little or no natural ventilation. Stickney includes a low-level ventilation actuation circuit which operates in response to detection of engine speed below a predetermined level. The speed circuit includes a speed sensor which may be connected to the ignition coil or distributor of an engine to output a signal having a frequency proportional to engine RPM. The signal is received by a one shot multivibrator which produces a pulse train having a pulse frequency directly proportional to engine RPM. This train of pulses is coupled to an integrator which operates to provide a voltage of a level directly proportional to the frequency of the multivibrator. The level of the voltage is compared to the level of a second voltage that is directly proportional to a preselected minimum engine RPM. If the actual engine RPM is below the minimum engine RPM, the ventilation system is actuated. As noted in the Stickney patent, the components of the speed circuit are different for different marine engines. The components are determined by the number of engine cylinders and the maximum engine RPM.

Engine startup and engine idling, or low cruise, are two of the more potentially hazardous times in which a vapor fire or explosion is likely to occur. However, fires and explosions may occur at any time. To explode, gasoline needs to be vaporized and mixed with air. The mixture can be caused by convection, evaporation, or a leak combined with the rocking motion of a marine vessel, as well as other reasons. The vapor/air mixture can thereafter be ignited by the spark from an alternator, or by a hot exhaust manifold, or by an unshielded electrical component.

It is an object of the present invention to provide a safety system for marine vessels which may be fit to a variety of boats without adaptations for the number of engine cylinders and the maximum RPM, and which is capable of detecting other potentially hazardous conditions.

SUMMARY OF THE INVENTION

The above object has been met by a safety system which includes engine-condition responsive apparatus which is non-electrical with regard to engine RPM detection, but which activates a ventilating device upon sensing that a marine engine is reduced from a high-cruise state to an idling or low-cruise state. The apparatus is a pressure-responsive element that senses vacuum fluctuations associated with the marine engine to provide a signal to a control unit for activating and deactivating the ventilating device.

The safety system includes the ventilating device, commonly referred to as a blower, for evacuation of gas from an engine compartment of an inboard engine vessel. The pressure-responsive element is a vacuum sensor having an input operatively coupled to the marine engine. Typically, the vacuum sensor is attached to the intake manifold of the engine. The vacuum sensor provides a voltage which is indicative of the vacuum condition of the engine. A drop from a high vacuum condition to a low vacuum condition is detected and an appropriate signal is received at a control unit. The control unit processes the signal received from the vacuum sensor and triggers the ventilating device accordingly.

In addition to receiving a signal from the vacuum sensor, the control unit is electrically attached to at least one vapor detector and a temperature sensor. The vapor detector and the temperature sensor are disposed in the engine compartment. A combination of a mixture of vapor and air with an ignition source does not necessarily result in an explosion. The mix of vapor and air must be within a range having a lower explosive limit and an upper explosive limit, otherwise an explosion will not take place. The control unit monitors the mix of air and fuel and activates the ventilating device upon detection of a dangerous condition. Moreover, the control unit includes timing circuitry which normally prevents engine startup until passage of a predetermined ventilation interval. The timing circuitry, however, can be circumvented by initiation of a manual override.

An advantage of the present invention is that it provides a safety system which can be attached to a wide variety of marine engines without adaptation for the number of engine cylinders or maximum engine RPM. Engine compartment ventilation occurs during a preignition interval, during engine idling and low cruise, and at any time in which the control unit detects a potentially dangerous degree of vapor content or heat or both. A visual display is provided to apprise a user of the condition of the ventilating device as well as the various sensors. An audio alarm is included to signal a dangerous condition of vapor and/or heat and any component malfunction.

BEST MODE FOR CARRYING OUT THE INVENTION

Figure 1:
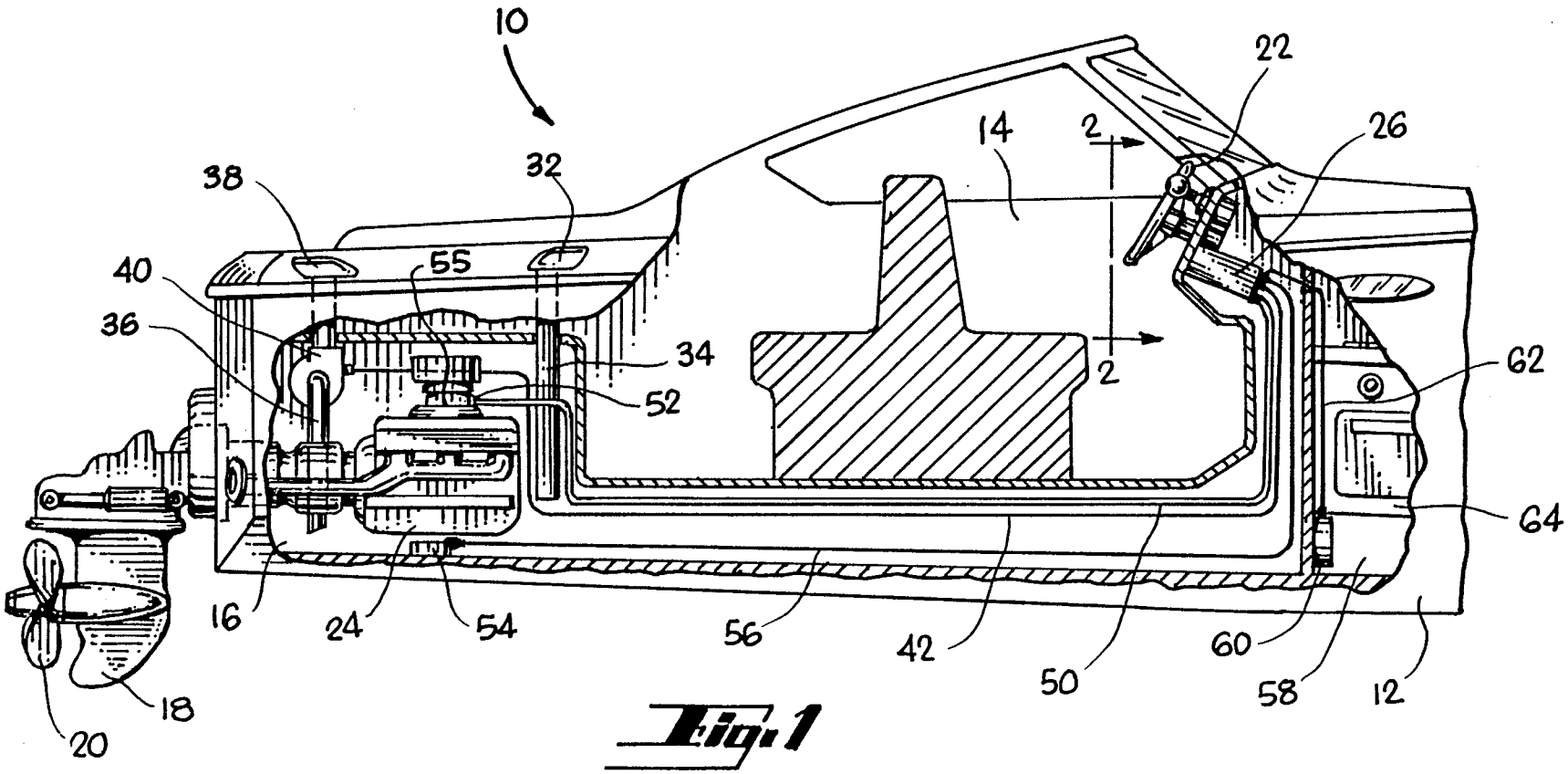
FIG. 1 is a partial side view, partly cut away, showing a vessel employing a safety system in accord with the present invention.

With reference to FIG. 1, a boat 10 is shown having a partially cut away hull 12 to expose the interior of a pilot area 14 and an engine compartment 16. At the rear of the boat 10 is a conventional rudder 18 which holds a propeller 20 and is controlled by manipulation of a steering wheel 22 in the pilot area 14. An internal combustion engine 24 powers the propeller 20 in a manner standard in the art.

Figure 2:
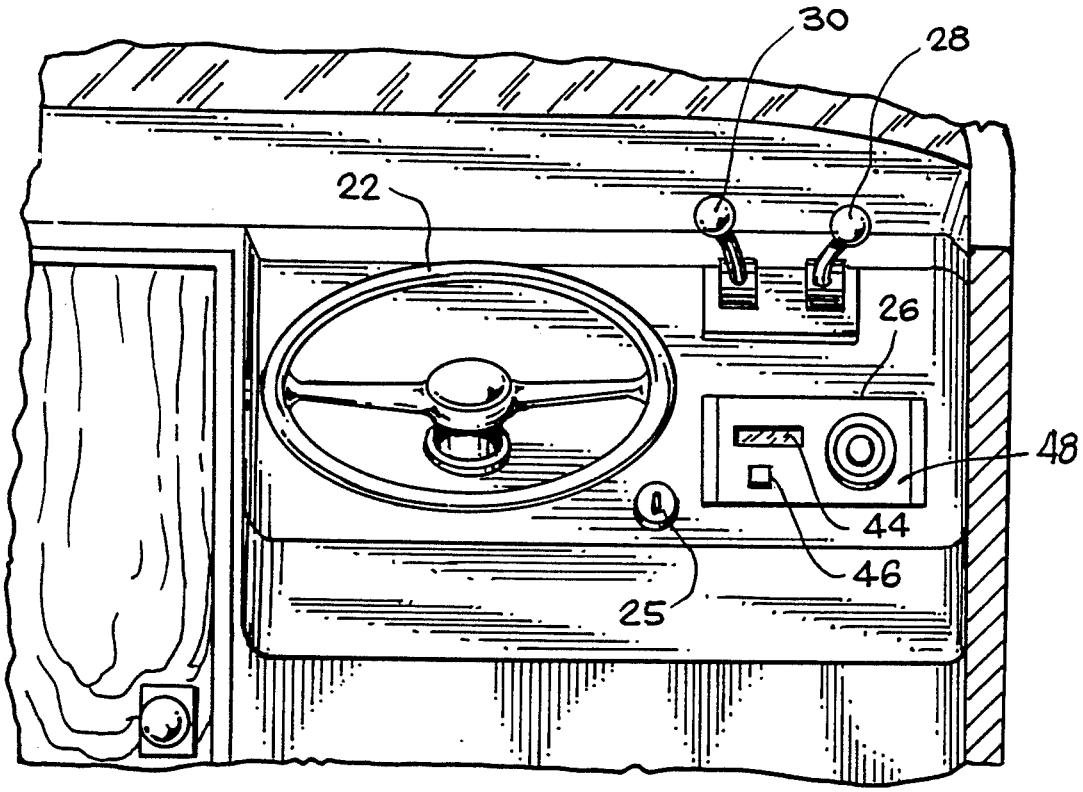
FIG. 2 is a front view of a control panel of the vessel of FIG. 1, taken along lines 2—2.

A control panel for operation of the boat is best seen in FIG. 2. The control panel includes the steering wheel 22, an ignition switch 25, and a control unit 26, as well as a throttle 28 and a gearshift 30. As explained more fully below, the ignition switch 25 and the control unit 26 are functionally related. The ignition switch is a three position member. The switch 25 includes an OFF position, an ON position, and an IGNITION position. Engine ignition, however, is prevented for some preset ventilation interval by the control unit 26.

Returning to FIG. 1, the combustion engine 24 is housed within the engine compartment 16 so as to shield passengers from the noise and fumes of the engine. The danger of such an arrangement is that vapor can accumulate within the engine compartment and such accumulation can result in a boat fire or explosion. A ventilation system in the engine compartment is provided to exhaust combustible vapor. The ventilation system begins with an intake port 32 that is connected to a ventilation conduit 34 for communication of the engine compartment 16 with the atmosphere. The intake port 32 permits an inlet of fresh air into the engine compartment. A second ventilation conduit 36 communicates with a ventilation exhaust port 38 via a blower 40. Because fuel vapor is more dense than air, the second ventilation conduit 36 should extend to near the bottom of the engine compartment 16.

Figure 3:
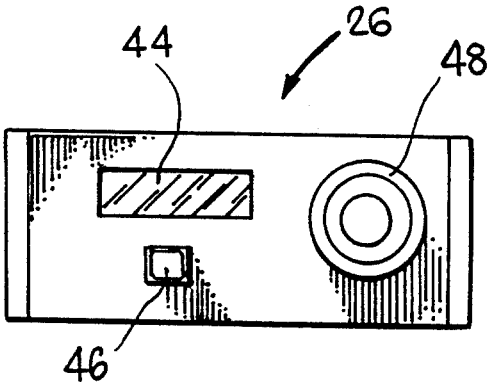
FIG. 3 is a front view of a control unit of FIG. 2.
Figure 4:
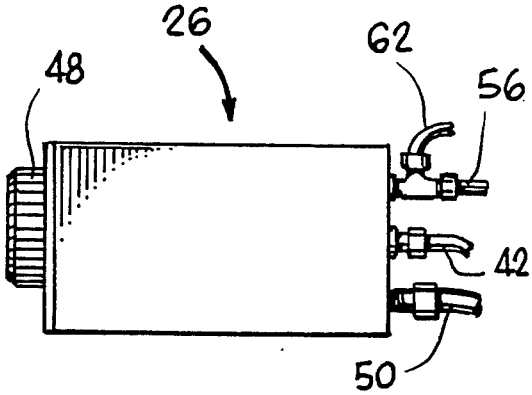
FIG. 4 is a side view of the control unit of FIG. 3.

The fuel, such as gasoline, for the engine 24 can vaporize and accumulate within the engine compartment 16 during extended periods in which the boat 10 is left stationary. For this reason, upon insertion and rotation of a key in the ignition switch of the boat, the blower 40 is actuated by the control unit 26. A wire 42 is shown connecting the control unit and the blower. Under normal conditions, timing circuitry within the control unit prevents ignition of the engine 24 for some preset ventilation interval, preferably four minutes. Referring to FIGS. 3 and 4, the control unit 26 includes a multi-character LCD display 44 to visually indicate the countdown of the ventilating interval. After passage of the four minute interval and the sensing of a safe condition, the ignition switch is enabled to permit engine ignition.

It is recognized that in emergency circumstances, a boat user may wish to bypass the ventilation interval. A manual override function is enabled by depression of a multi-function switch 46 on the face of the control unit 26. Such disablement, however, involves some risk. Therefore, upon first depression of the switch 46, the control unit maintains the engine in a preignition state while it is determined whether a potentially dangerous condition exists in the engine compartment 16. If danger is detected, a warning of the potential danger, as well as an instruction to remove the engine cover from the engine compartment, is provided at the LCD display 44 prior to enablement of the manual override function. If, on the other hand, no danger is present, the manual override is immediately enabled.

The control unit 26 also includes an audio alarm 48. As explained more fully below, the audio alarm provides an audio warning of a dangerous condition in the engine compartment or of a component malfunction.

Referring again to FIG. 1, the control unit 26 is attached to the engine 24 by a line 50. Upon acceleration of the engine, the control unit 26 automatically cycles the blower 40 to a deactivated state. However, accumulation of vaporized fuel within the engine compartment is more likely to take place when the internal combustion engine 24 is in an idling or low cruise operation. It is desirable to activate the blower 40 during such operation. The line 50 between the control unit and the engine permits communication between these elements for selective activation of the blower 40. During acceleration and normal running of the boat 10, the intake manifold of the engine is in a relatively low vacuum condition. In fact, at full acceleration the pressure at the intake manifold may reach atmospheric pressure. On the other hand, idling and low cruise operation of the engine is associated with a high vacuum condition at the intake manifold of the engine. A vacuum sensor 52 at the intake manifold 55 of the engine detects the engine vacuum condition.

The vacuum sensor 52 transmits a signal to the control unit 26. The signal has a characteristic which is proportional to the engine vacuum condition. The signal characteristic may be one of signal voltage, signal frequency, or signal current, for example. As the vacuum pressure at the intake manifold increases or decreases, the signal characteristic varies accordingly. Alternatively, the signal which is transmitted through line 50 may be simply a high/low variation. For example, it may be desirable to transmit a blower-activation high signal when vacuum pressure at the intake manifold is greater than 450 mm Hg while transmitting a blower-deactivation low when vacuum pressure is below the 450 mm Hg level. The control unit 26 maintains the blower 40 in an operative condition when the engine gauge pressure is within a range of pressures proximate to a minimum engine gauge pressure.

A rich mixture of fuel and air is required for idling and small throttle openings. Such a mixture is more likely to result in vaporization of fuel for accumulation in the engine compartment. Moreover, an idling or low cruise operation limits the natural ventilation accompanying a moving boat. A vacuum detection system insures actuation of the blower 40 during idling and low cruise operation of the engine.

The fuel/air ratio is important not only for carburetion of the engine 24, but also in determining flammability of an accumulation of fuel vapor in the engine compartment 16. There a rich limit of flammability beyond which a mixture of fuel vapor and air will not ignite. Likewise, there is a lean limit of flammability. The control unit 26 receives signals from a vapor sensor 54 via a wire 56. The vapor sensor 54 detects the vapor content within the engine compartment 16. Preferably, the vapor sensor also includes a heat sensor which also transmits a signal to the control unit. The transmitted signals have a characteristic which is proportional to the elements being sensed. Set thresholds within the control unit 26 determine actuation of the blower 40. For example, detection of a particularly volatile fuel/air mixture causes activation of the blower 40 regardless of the temperature within the engine compartment 16. In like manner, the detection of an extreme temperature within the engine compartment initiates ventilation regardless of the fuel/air ratio. Between these two absolute conditions there is a wide range of programmed vapor/heat conditions which will cause the control unit to activate the blower.

While the vapor and heat sensor of FIG. 1 are shown as one unit, preferably the sensors are disjoined. The vapor sensor 54 is mounted toward the bottom of the engine compartment since fuel vapor is more dense than air. The vapor sensor should be removed from the bottom of the engine compartment 16, however, since the sensor cannot be allowed to be submerged in bilge water that collects in the engine compartment. On the other hand, a heat sensor is optimally maintained at the upper extent of the engine compartment since heat rises in relatively stagnant air.

The boat 10 of FIG. 1 includes a galley area 58. A second vapor sensor 60 within the galley area communicates with the control unit 26 via a wire 62. The vapor sensor 60 is of the type to detect propane vapor. The galley area 58 has a propane oven. Leakage of propane from the oven 64 is detected by the sensor 60 and registered by the control unit 26. The audio alarm of the control unit as well as the video display alert a boat operator to a potentially hazardous condition.

Figure 5:
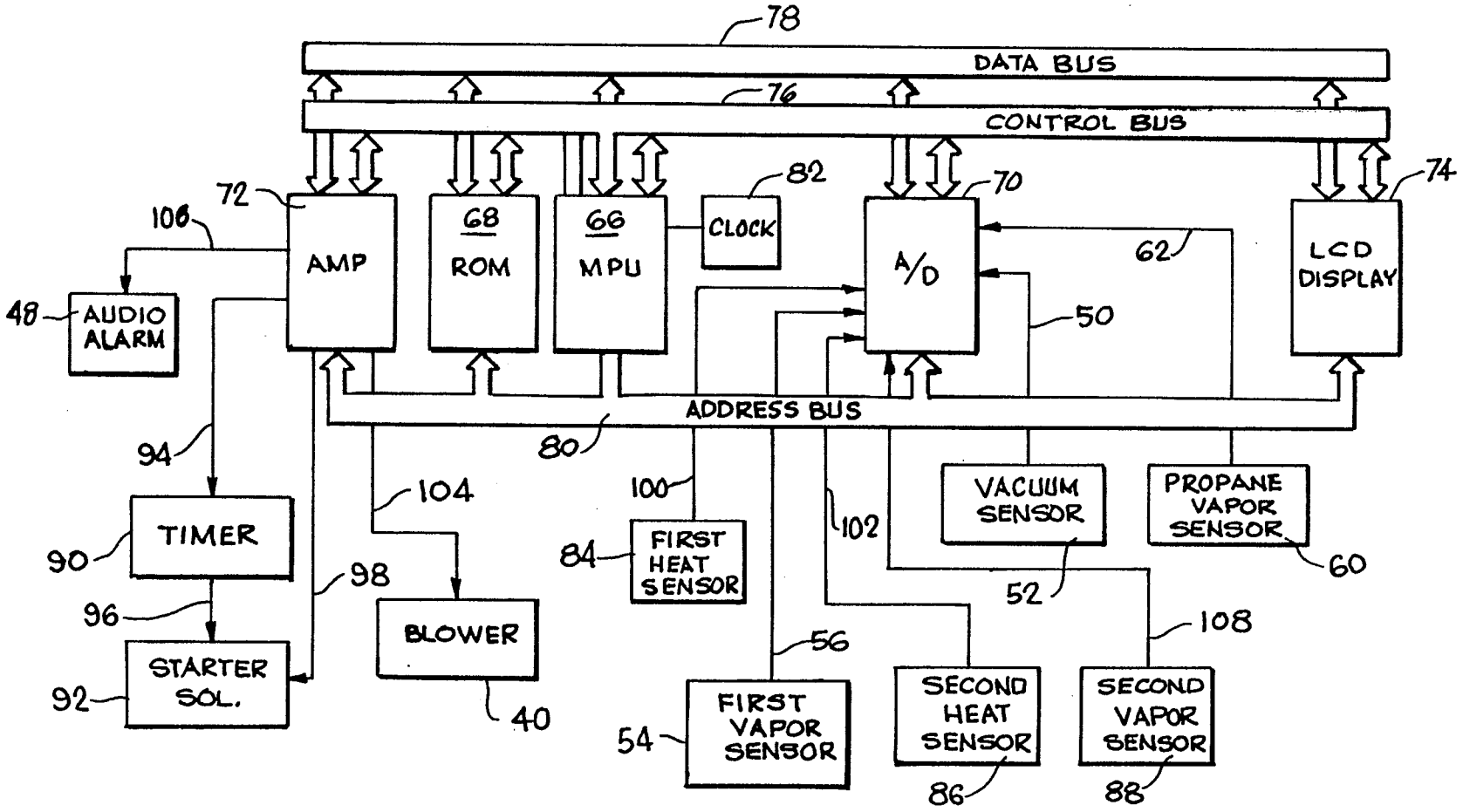
FIG. 5 is a schematic representation of the safety system of FIG. 1.

FIG. 5 illustrates exemplary circuitry for a boat safety system. The circuitry includes a microprocessor (MPU) 66, erasable programmable read-only memory (ROM) 68, an analog-to-digital converter (A/D) 70, a current amplifier (AMP) 72 and an LCD display (DISPLAY) 74. The various devices 66–74 are interconnected by a control bus 76, a data bus 78 and an address bus 80, all in a manner known in the art.

The microprocessor 66 may be 80C31 manufactured under the trademark Advanced Micro Devices. The time basis is generated by a 3.6864 MHz quartz clock 82. The 80C31 includes on-chip random access memory (RAM). The devices 68–74 are addressed and controlled by the microprocessor 66. The RAM device 68 is a non-volatile, memory, such as an 87C64 device sold under the trademark Intel.

Signals are received at the A/D converter from sensors disposed within the boat. For example, a first vapor sensor 54 is operatively associated with a first heat sensor 84. As noted above, the vapor sensor 54 transmits a signal through line 56, with the signal having a characteristic corresponding to the vapor content at the sensor. Where the vapor sensor 54 detects a fuel/air ratio which evidences a particularly explosive condition, the current amplifier 72 is controlled by the microprocessor 66 so as to activate both the blower 40 and the audio alarm 48. However, where something less than an extremely volatile condition is detected, there is an interplay between the first vapor sensor 54 and the first heat sensor 84. The ROM device 68 stores up to 256 distinct situations for activation of the blower and the audio alarm. A less volatile fuel/air ratio causes activation if the temperature within the engine compartment is higher than normal. In a large boat it is desirable to have a second heat sensor 86 and a second vapor sensor 88 which may be located within an engine compartment opposite the first sensors 54 and 84.

The vacuum sensor 52 is tied to the A/D converter by the line 50. Detection of a high vacuum associated with idling or low cruise operation of a marine engine causes the microprocessor 66 to actuate the blower 40. Here, no audio alarm 48 is sounded. However, a visual read-out of the activation/deactivation state of the blower is triggered at the LCD display 74. A display table of at least 16 preselected read-outs are stored within the ROM device 68. The microprocessor addresses the ROM device and controls data transmission from the ROM device to the LCD display.

Yet another input to the A/D converter 70 is from the propane vapor sensor 60 in the galley of the boat. Detection of a hazardous condition by any of the three vapor sensors 54, 60 and 88 produces an audio warning and a visual warning by means of the alarm 48 and the display 74.

In operation, a boat user inserts an ignition key into a conventional ignition switch and rotates the key to the ON position of the switch. The blower 40 is immediately actuated and a four minute countdown of a ventilating interval is begun. The countdown is visually shown on the LCD display 74. For purposes of illustration, a timer 90 is schematically included in FIG. 5. Upon expiration of the ventilating interval, a relay is activated and current is provided to the starter solenoid 92 of the boat. Current from the current amp 72 is supplied to the timer 90 and the starter solenoid 92 by means of lines 94 and 96. Alternatively, a boat operator can manually override the ventilating interval function so as to provide direct current to the starter solenoid via line 98. The manual override is to be used in emergency situations only.

Prior to engine ignition, each sensor 52, 54, 60, 84–88 is addressed to determine operability. The inputs are addressed individually. A sensor transmits an analog signal to the A/D converter 70. A ramp capacitor is charged and then discharged. The discharge time is measured and because the value of the capacitor is known, the analog value, i.e. voltage, from the particular signal can be calculated. If a sensor is determined to be inoperable or faulty, or if an analog value evidences a dangerous condition, an appropriate visual read-out is provided to the LCD display 74 and the audio alarm 48 is sounded. The operator decides whether to immediately repair an inoperable sensor or to turn off the alarm and proceed with use of the boat as originally planned, in which case the read-out and alarm will be enabled each time the boat is restarted. The alarm and read-out are turned off by depression of the switch on the control unit.

Upon docking or storing of a boat, the microprocessor is placed in a power down state. In such a state, a real time clock is maintained and the individual sensors are periodically polled. For example, at the top of every hour the first and second heat sensors 84 and 86 may be polled via lines 100 and 102. More importantly, the vapor sensors 54 and 88 are polled via lines 56 and 108 to determine whether a high vapor/air ratio is present. If a potentially dangerous condition is sensed, the current amplifier 72 is addressed and controlled to activate the blower 40 by channeling current through line 104. At such time, the audio alarm 48 is initiated through the line 106.

Another feature of the control unit is the diagnostic function. During installation or maintenance of the control unit and sensors, it is possible to analyze signals from the control unit for the purpose of determining the operability of components and the source of various malfunctions. The sensors and certain control unit components are sequentially ordered for diagnostic purposes and if a malfunction is detected the assigned number of the sensor or component is cited as needing repair or replacement.

While the present invention has been explained with reference to a gasoline engine, the safety system may be used with engines that operate on other fuels. For example, an engine which is powered by alcohol or diesel substances may be monitored. The expected range of voltages from the various sensors, however, may be different for different fuels and the ROM device 68 should be adjusted accordingly.

I claim:

1. A safety system for ventilation of a marine engine compartment having a ventilating device for exhausting gas therefrom, said compartment housing a marine engine, said safety system comprising, means for sensing a specified engine vacuum condition, said sensing means having an input operatively connected to said marine engine to detect vacuum pressure associated therewith and having an output, and control means operatively connected to said output for activating and deactivating said ventilating device in response to said sensing of vacuum pressure, said control means activating said ventilating device upon detection of said specified engine vacuum condition.

2. The safety system of claim 1 wherein said specified engine vacuum condition is a high vacuum condition, said control means including electrical switching circuitry to activate said ventilating device upon sensing of said specified engine vacuum condition, said specified engine vacuum condition being one associated with engine idling and engine low-cruise operation.

3. The safety system of claim 2 wherein said sensing means includes a vacuum sensor coupled to an intake manifold of said marine engine to detect engine pressure, said vacuum sensor adapted to output a signal to said control means, said signal causing said switching circuitry to activate said ventilating device upon sensing that said intake manifold is approaching a maximum vacuum condition, said specified engine vacuum condition further being associated with engine deceleration.

4. The safety system of claim 1 wherein said control means includes a visual display for indicating the activated/deactivated state of said ventilating device.

5. The safety system of claim 1 wherein said control means includes circuitry for selectively activating said ventilating device in response to vapor content within said engine compartment.

6. The safety system of claim 1 wherein said control means includes a timer for activating said ventilating device for a preselected period of time prior to placement of said marine engine in a condition for engine ignition.

7. A safety system for a marine vessel having an engine housed within an engine compartment comprising, means for ventilating said engine compartment, control means for selectively activating and deactivating said ventilating means, and means including a vacuum sensor operatively coupled to said engine for detecting a first condition in which said engine advances from a low vacuum state to a high vacuum state, said detecting means having an output connected to said control means, said control means including circuitry for activating said ventilating means upon detection of said first condition.

8. The safety system of claim 7 wherein said vacuum sensor further detects a second condition in which said engine advances from said high vacuum state to said low vacuum state, said control means having circuitry for the purpose of deactivating said ventilating means upon detection of said second condition.

9. The safety system of claim 7 wherein said vacuum sensor is coupled to an intake manifold of said engine.

10. The safety system of claim 7 wherein said ventilating means is a blower.

11. The safety system of claim 7 wherein said control means includes a vapor sensor disposed in said engine compartment, said control means selectively activating and deactivating said ventilating means in response to vapor content at said vapor sensor.

12. The safety system of claim 7 wherein said control means includes a timer operatively associated with said engine to maintain said engine in a preignition state for a preselected period of time, said ventilation means being activated during said period of time.

13. The safety system of claim 12 wherein said control means includes a manual override circuit to selectively remove said engine from said preignition state during said period of time.

14. A boat system for ventilation of an engine compartment having a marine engine comprising, means for ventilating said engine compartment, control means for selectively operating said ventilating means, and a vacuum sensor having an input operatively coupled to said marine engine to detect engine pressure, said vacuum sensor having an output operatively coupled to said control means, said control means having circuitry to maintain said ventilating means in an operative condition when said engine pressure is within a range of pressures proximate to a minimum operating engine pressure.

15. The safety system of claim 14 wherein said control means maintains said ventilating means in said operative condition when said engine pressure is a pressure within a range associated with standard marine engine idling and low cruise conditions.

16. The safety system of claim 14 wherein said control means includes a visual display for indicating the operative condition of said ventilating means.

17. The safety system of claim 14 wherein said ventilating means is a blower disposed in said engine compartment.

18. The safety system of claim 14 wherein said vacuum sensor is connected to the intake manifold of said marine engine.

* * * * *